United States Patent [19]

Poeppelman et al.

[11] Patent Number: 4,813,360

[45] Date of Patent: Mar. 21, 1989

[54] APPARATUS FOR BURNING WASTE PRODUCTS

[76] Inventors: Edward Poeppelman; Jeff Poeppelman, both of 10760 S.R. 66, R.R. #2, Minster, Ohio 45865

[21] Appl. No.: 33,668

[22] Filed: Apr. 3, 1987

[51] Int. Cl.[4] ..... F23G 5/00; F23G 5/12; F23G 5/44; F23G 7/00

[52] U.S. Cl. ..... 110/259; 110/235

[58] Field of Search ..... 110/236, 237, 238, 259, 110/255, 235

[56] References Cited

U.S. PATENT DOCUMENTS

| | | | |
|---|---|---|---|
| 2,014,714 | 9/1935 | Bauer | 431/337 |
| 3,704,676 | 12/1972 | Davies et al. | 110/238 |
| 3,748,081 | 7/1973 | Hummel | 110/238 X |
| 3,749,029 | 7/1973 | Bakker et al. | 110/238 |
| 4,136,624 | 1/1979 | Kato et al. | 110/236 |
| 4,481,891 | 11/1984 | Takeshita et al. | 110/238 |
| 4,619,210 | 10/1986 | Kennedy | 110/259 |

*Primary Examiner*—Edward G. Favors

*Attorney, Agent, or Firm*—John B. Dickman, III

[57] ABSTRACT

A method and apparatus for completely burning waste products such as petroleum oil, plastics and rubber where combustion air is mixed with the incinerating waste products from above an inner chamber housing the burning waste products. All fuels can be burned with this method and apparatus.

1 Claim, 1 Drawing Sheet

APPARATUS FOR BURNING WASTE PRODUCTS

BACKGROUND OF THE INVENTION

The present invention relates to an apparatus and method for the complete burning of waste products, such as used petroleum oil, plastics, tires and all fuels. Burning of waste products has caused environmental problems which has brought above government regulations on waste disposal. Air pollution being the number one environmental concern because of unburned or partially burned health hazardous waste products, including sulfur and nitrogen gaseous chemicals and chemical ash solids.

There are restrictions on burning waste products which require means for treating the fumes given off in the burning process to either collect hazardous waste or insuring more complete burning of waste products to change the chemical state of hazardous waste to non-hazardous chemicals. The use of filters and fume scrubbers is well known in the field of air pollution cleaning equipment. This equipment is, however, very expensive to purchase and operate, therefore, a better solution to the problem would be to have more complete burning of waste products to reduce the waste to a non-hazardous product that can either be dispensed into the atmosphere as acceptable non-polluting gases or to remove them as non-hazardous solid waste in the form of ash which can be buried without the fear of ground pollution. Several patents are devoted to fume filters and scrubbers for cleaning partially burned gases and solids given off in waste burning. Several other patents are directed to more complete burning of waste products to change the chemical state of the products to non-hazardous gases and solids.

The inventor is aware of the following U.S. Pat. Nos. for burning waste products: 1,791.223, 2,014,714, 2,344,218, 2,580,179, 3,195,608, 3,946,680, 4,113,445.

Of the above listed patents only U.S. Pat. No. 2,014,714 issued to Bauer and U.S. Pat. No. 3,195,608 issued to Voorheis et al are of interest to the present invention in terms of apparatus. The other cited patents represent the state of the art.

U.S. Pat. No. 2,014,714, Bauer, discloses an oil burner having a combination chamber in which waste oil is fed into the bottom of the chamber and ignited by a flame. Combustion air is fed into the chamber by a perforated ring mounted in the chamber above the waste oil fee. The combustion air co-mingles with the fumes given off by the burning oil for more complete burning. Baur attempts to burn the rising waste fumes as the fumes leave the chamber, however, some of the fumes are likely to escape unburned since the air feed is directed out of the chamber, which is entirely different from the present invention.

U.S. Pat. No. 3,195,608, Voorheis et al provides a volatile waste incinerator with a bottom center feed of diesel fuel and peripheral air feeds. The air feeds are slightly above the diesel fuel feeder to provide a good air to fuel mixture for burning volatile waste.

It is a primary object of this invention to provide a waste product burner apparatus and method for the complete burning of waste products without introducing pollutants into the atmosphere. The term "waste products" includes all fuels.

Another object of this invention is to provide a waste product burner apparatus in which combustion air is added above the waste product fuel for complete burning.

Still another object of this invention is to provide a waste product burner apparatus for complete burning of waste petroleum oils, plastics and tires without polluting the atmosphere.

A further object of this invention is to provide an inexpensive waste product burner apparatus that is inexpensive to manufacture and to operate.

SUMMARY OF THE INVENTION

This invention relates to the field of waste products burning and the protection of the atmosphere, more specifically the invention relates to an apparatus and method for getting rid of waste burnable products by complete burning to destroy hazardous chemicals that would otherwise pollute the atmosphere.

The waste product burner apparatus includes an inner chamber that has an open top and closed side walls and bottom, except for a waste product feed and a fuel igniter. Combustion air for complete burning of waste products is fed to the inner chamber from above the chamber to mix with the burning waste products, bring about complete and pollution free fumes or gases. As the waste product initially burns, burning gases and lighter particles rise, mixing with increasing amounts of combustion air to the point where the ratio of air to waste product is at an optium for complete burning.

The combustion air is fed to the inner chamber from a downwardly facing nozzle connected to a pressure line. The pressure of the air churns in the chamber mixing with the burning waste product. As the waste product burns heavier solids such as ash collects in the bottom of the container for later removal or it collects on a conveyor which continuously removes the ash.

DESCRIPTION OF THE PREFERRED EMBODIMENT

Figure 1:
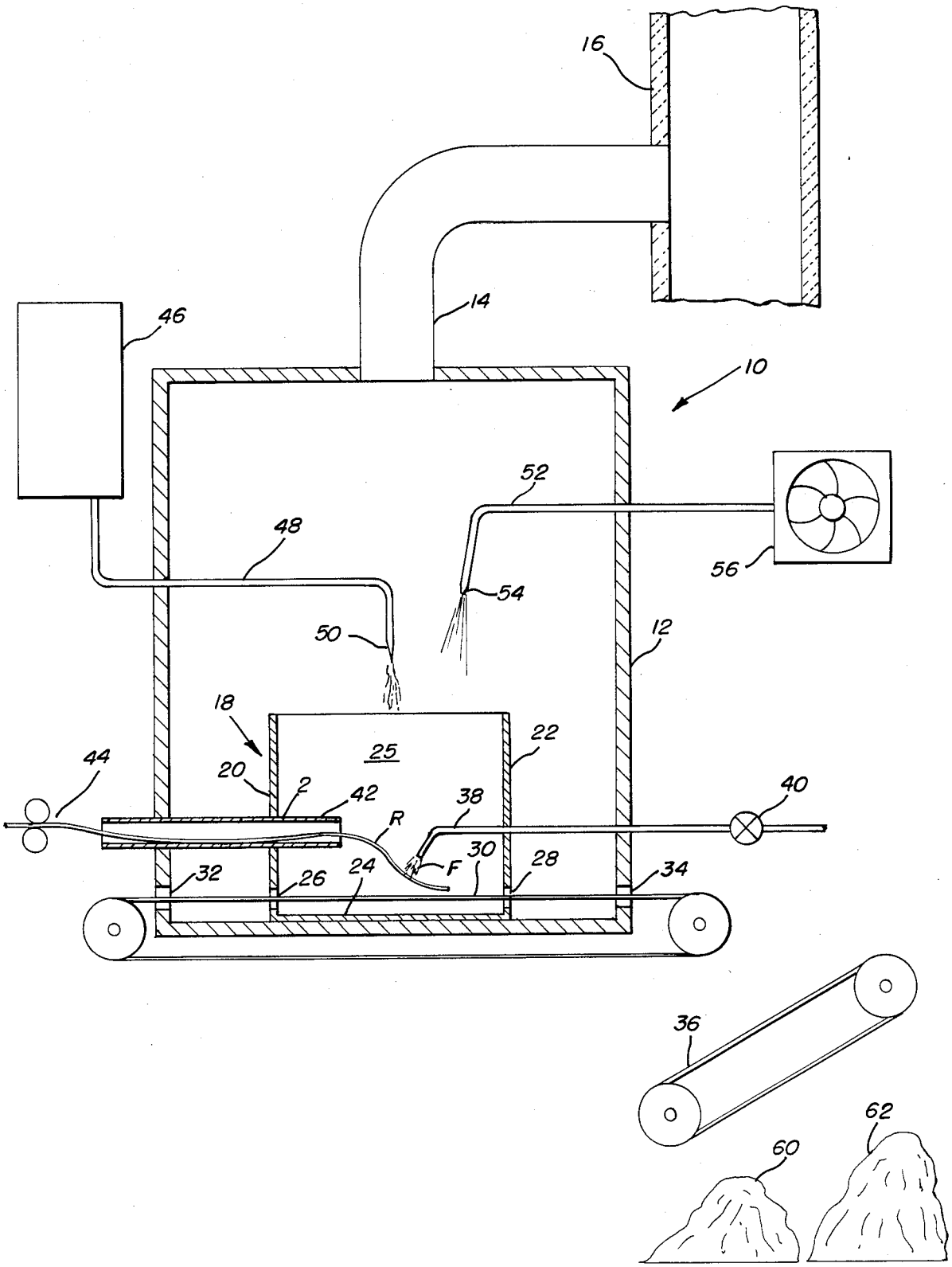
FIG. 1 is a cross sectional plan view of a waste product and all fuel burner of the invention.

Referring to the drawing there is shown a waste product burner 10 having an outer incinerator body 12 made of metal, depending on the heat generated in the incinerator 12, it may be lined with a refractory material. A flue 14 is connected to the incinerator body 12 and to an exhaust stack 16. The flue 14 is made of metal lined and wrapped with a heat insulating material. The incinerator body 12 has a loading door (not shown) for caring for the equipment.

An inner chamber 18 is positioned in the incinerator 12 and it has side walls 20 and 22, end walls 25 (one shown) , and a bottom 24. The inner chamber 18 does not have any air ports to mix air with the fuel. The inner chamber 18 is made of metal. There is shown an opening 26 in wall 20 and an opening 28 in wall 22 through which a conveyor belt 30 passes. The conveyor belt 30 also passes through openings 32 and 34 in incinerator body 12 to carry scrap metal and ashes from inner chamber 18 through and out the incinerator 12 to a second conveyor 36 for separation and dumping.

A gas line 38 extends into the inner chamber 18, passing through incinerator body 12 and inner chamber 18. Gas line 38 has a shut off valve 40 and connects either to a propane tank, (not shown) or to another source of propane or natural gas. The flame from the gas line 38 ignites the waste product. There is enough air available in the bottom of the inner chamber 18 to support combustion, but not enough to incinerate the waste product.

A waste product feed conduit 42, leading from the outside through the incinerator body 12 and inner chamber 18, is used to feed solid waste products such as strips of rubber or plastic to the inner chamber 18. Strips of waste product are paged through the conduit 42 by rollers 44.

When petroleum oil in incinerated, the oil is fed from a tank 46 through line 48 to a nozzle 50 above the inner chamber 18. If the waste product burner 10 is used exclusively for petroleum oil, the conveyors 30 and 36 may not be needed, in which case inner chamber 18 does not have openings 26 and 28, or conduit 42.

An air feed line 52 extends into the incinerator 12 above the inner chamber 18 and oil nozzle 50. The air feed line 52 has a nozzle 54 at an angle from the horizontal. With the nozzle 54 at an angle the pressure of the air leaving the nozzle will cause a churning or swirling action in the inner chamber 18, mixing the air and the ignited waste product for better combustion. Air feed line 52 is connected to a blower 56 or some other air Pressure source that can be regulated.

In operation, a waste product, for example, strips of rubber R are fed into inner chamber 18 on to conveyor belt 30. A flame F from gas line 38 ignites and starts the incineration of the rubber, relying on the ambient air available in the inner chamber 18. Combustion air from nozzle 54 is projected into the inner chamber at an angle to cause a complete mixing of air and fuel. As the air and incinerating rubber mix, lighter waste product gases and solids rise and burn even more completely until there are no hazardous gases and solids leaving the incinerator 10 through flue 14 and stack 16.

Any metal scrap or ash collected on conveyor belt 30 is discharged on to conveyor 36, which has an open mesh belt to allow smaller particles and ash to pass through and be collected at 60. Metal scrap is emptied from the conveyor 36 on to a scrap pile 62.

Often it is necessary to incinerate autombile tires. The present incinerator 10 can be modified to accommodate tires, by enlarging the openings 32 and 34 in the incinerator body 12 and openings 26 and 28 in the inner chamber 18.

It should be understood that while only one embodiment has been shown that one skilled in the field may realize other embodiemnts. Therefore, one should study the drawing, specification and claims for a full understanding of the invention.

I claim:

1. An apparatus for completely burning all fuel and waste products to remove polluting gases and solids from the fumes admitted to the atmosphere comprising;

an incinerator body for containing incinerated waste products, said incinerator body having a flue means to remove spent gases;

an inner chamber in said incinerator body for incinerating waste products, said inner chamber having side wall means integral with end means and a bottom means;

means for starting the waste products burning where said means is located in said inner chamber and uses available air to initiate burning;

means for injecting combustion air into said inner chamber including at least one air nozzle means above said inner chamber to cause a mixing of combustion air and burning gases and solids from the waste products for complete burning of the polluting gases and solids, said waste products feed through a conduit into the inner chamber below the combustion air nozzle means, a waste feed means including a nozzle feed, means for injecting said waste products to said inner chamber, and a conveyor to remove incinerated solid waste from said inner chamber and said incinerator body where said conveyor passes through the wall of the incinerator body and side wall means of said inner chamber.

* * * * *